United States Patent [19]

Matsumiya et al.

[11] Patent Number: 4,549,904

[45] Date of Patent: Oct. 29, 1985

[54] PROCESS FOR THE PREPARATION OF PELLETS

[75] Inventors: Saburo Matsumiya, Chiba; Katsuya Uehara; Keiji Saito, both of Mobara; Hideyuki Michiki; Kenichi Yaginuma, both of Chiba, all of Japan

[73] Assignee: Toyo Engineering Corporation, Tokyo, Japan

[21] Appl. No.: 385,362

[22] Filed: Jun. 7, 1982

[30] Foreign Application Priority Data

Jun. 26, 1981 [JP] Japan ..... 56-99237

[51] Int. Cl.[4] ..... C22B 1/24

[52] U.S. Cl. ..... 75/7; 75/3; 75/6

[58] Field of Search ..... 75/3–9; 44/25

[56] References Cited

U.S. PATENT DOCUMENTS

| | | | |
|---|---|---|---|
| 3,870,507 | 3/1975 | Allen | 75/4 |
| 3,876,416 | 4/1975 | Yamaki et al. | 75/4 |
| 3,941,582 | 3/1976 | Baum | 75/4 |

FOREIGN PATENT DOCUMENTS

| | | | |
|---|---|---|---|
| 1272944 | 7/1968 | Fed. Rep. of Germany | 75/5 |
| 38-4151 | 4/1963 | Japan | 75/7 |

*Primary Examiner*—L. Dewayne Rutledge
*Assistant Examiner*—S. Kastler
*Attorney, Agent, or Firm*—Flynn, Thiel, Boutell & Tanis

[57] ABSTRACT

A process for the preparation of pellets is disclosed which comprises mixing an iron ore raw material with a pitch material having a softening point of 30° to 300° C. in an amount in the range of 0.5 to 5% by weight of the iron ore raw material, molding the mixture, and heating the molded material under a reducing atmosphere to remove arsenic contained therein.

12 Claims, No Drawings

PROCESS FOR THE PREPARATION OF PELLETS

This invention relates to a process for the preparation of pellets in which an iron ore raw material is treated to remove arsenic and other impurities contained therein, thereby producing pellets that can be employed as a starting material in the manufacture of iron and steel. More particularly, this invention relates to a process for removing arsenic in the course of the preparation of the pellets, which comprises: mixing an iron ore containing arsenic, such as pyrite cinder, with a pitch material that acts as a reducing and combining agent, such as a delayed thermal cracking pitch (referred to hereinbelow as DPC pitch), thermal cracking coal tar pitch, petroleum extract, and solvent refined coal (referred to below as SRC), granulating the mixture to form pellets, and firing the granulated mixture under a reducing atmosphere.

Pyrite cinder, which is obtained by roasting or firing pyrite ore, is an important raw material for the manufacture of iron. Most pyrite cinders produced by means of the recently developed fluidized bed firing technology are in a powdery form, and contain nonferrous metals such as As, Cu, Zn and Pb that have harmful effects on the manufacture of iron. Accordingly, these harmful metals must be removed from the pyrite cinders in order to provide raw materials suitable for the manufacture of iron of good quality.

Japanese Patent Publication No. 44(1969)-7827 discloses a process for the treatment of pyrite cinders containing relatively small amounts of arsenic, which comprises mixing and kneading the pyrite cinder with a $CaCl_2$ chlorinating agent, subjecting the mixture to crushing by grinding or the like, granulating and drying procedures, and firing or roasting the mixture in a rotary kiln to volatilize the nonferrous materials from the pyrite cinder. This is the chloride volatilization process.

As for processes employable in the case of pyrite cinders containing a large amount of arsenic, there is disclosed in Japanese Patent Publication No. 54(1979)-14562 a process comprising firing pyrite cinders with a mixed chlorinating agent consisting of $CaCl_2$ and $NH_4Cl$ and thereby volatilizing arsenic together with Cu, Zn, Pb and the like. There is also known a process comprising forming pyrite cinders together with both a chlorinating agent and a reducing agent, such as carbon, into pellets and then removing arsenic under neutral or reducing conditions. See Japanese Patent Publication No. 45(1970)-28092.

However, the simultaneous removal of As and Cu, Zn and Pb metals is rather difficult because of the differences of the reactivities of arsenic and other metals. Even if simultaneous removal can be achieved, it is necessary to separate As from the other metals, such as Cu, Zn and Pb, in order to recover the valuable metals. The procedures for such separation and recovery are rather complicated and less practical. Thus, the above-cited processes are not practical enough.

Most of the arsenic in pyrite cinder is present therein in the form of $FeAsO_4.2H_2O$ (scorodite). This iron arsenate decomposes under heating to produce gaseous arsenious acid according to the following equation (1):

$$4FeAsO_4 \rightarrow 2Fe_2O_3 + 2O_2 + As_4O_6 \quad (1)$$

This decomposition reaction releases oxygen, and accordingly, on a theoretical basis, this reaction is not preferably carried out with heating under an oxygen-containing or oxidative atmosphere. It is known that this reaction proceeds easily under conditions enabling reduction of iron arsenate by the use of a reducing agent. When carbon monoxide or coke is employed as the reducing agent, gaseous arsenious acid is produced according to the following equations (2) and (3), respectively, and is eliminated from pyrite cinders:

$$4FeAsO_4 + 4CO \rightarrow 2Fe_2O_3 + 4CO_2 + As_4O_6 \quad (2)$$

$$4FeAsO_4 + 4C \rightarrow 2Fe_2O_3 + 4CO + As_4O_6 \quad (3)$$

The mechanism of the reduction of iron arsenate in the above reactions is assumed to follow the equations (4), (4') and (5) via iron arsenite.

$$FeAsO_4 + CO \rightarrow FeAsO_3 + CO_2 \quad (4)$$

or $$FeAsO_4 + C \rightarrow FeAsO_3 + CO \quad (4')$$

$$4FeAsO_3 \rightarrow 2Fe_2O_3 + As_4O_6 \quad (5)$$

The reductive decomposition reaction of iron arsenate using these reducing agents is advantageous, as compared with the thermal decomposition reaction according to the equation (1), because the former proceeds at a higher reaction rate.

The reaction for volatilizing compounds of Cu, Zn, Pb and the like in the form of metal chlorides for the purpose of separation of these compounds proceeds only under an oxidative atmosphere. Accordingly, there is employed a separation process comprising two steps when pyrite cinder or other iron ore containing As as well as Cu, Zn and Pb is to be treated for the manufacture of iron. The first step comprises removal of arsenic through selective reduction by the use of a reducing agent, and the second step comprises removal of such metals as Cu, Zn and Pb in the form of volatile chloride compounds by the use of a chlorinating agent. From an economic point of view, coal or coke is generally employed as the reducing agent in the first step, and $CaCl_2$ or the like is employed as the chlorinating agent in the second step.

The present inventor has discovered that nonferrous metals can be efficiently removed from pyrite cinder and the like by the use of a reducing agent selected from pitch materials having specific properties, such as delayed thermal cracking pitch, thermal cracking tar pitch, coal extract and the like. Such pitch materials are used in the first reduction step of the two-step process, where the raw material, pyrite cinder or the like, is treated with reducing agent to remove arsenic in the first step and is treated with a chlorinating agent such as $CaCl_2$ or the like to remove other metals. The pitch materials described above have not previously been employed as the reducing agent in the above-mentioned first step.

As the reducing agent used for the treatment of pyrite cinder, coal has been previously employed in the amount of approximately 3% by weight, based on the weight of the pyrite cinder. In this process, the removal of arsenic is achieved by finely crushing both the pyrite cinder and the coal into particles so that particles having diameters of less than 44$\mu$ comprise more than 80% of the total particles, mixing both of the finely crushed materials, molding the mixture, and heating the molded mixture at 1000°-1050° C., under a reducing atmosphere, in a rotary kiln.

The above-described process, however, has the following problems. Since the difference in the specific gravities of the pyrite cinder and the coal is substantially large, the required homogeneous mixing of the finely crushed pyrite cinders and the finely crushed coal can be achieved only when a special means to achieve uniform mixing is provided in the treating apparatus or method. Also, since water is added in the process for kneading and granulating the mixture, a certain amount of water is always contained in the pellets just after molding, and if the water content in the pellets is too high, the pellets are often converted to a powder during heating in the rotary kiln because of rapid volatilization and expansion of the water present in the pellets. This conversion to a powder disturbs the continuity of the operation and, accordingly, it is necessary to provide a drying step for the pellets prior to the heating step. This step is disadvantageous due to the additional installation and operation costs.

Another problem concerning the use of coal as a reducing agent is that the reductive removal of arsenic from pyrite cinder requires a high temperature, usually higher than the range of 850°-900° C. Therefore, low boiling components that volatilize from the coal and hydrocarbons that decompose to give gaseous materials, during the course of elevation of the temperature up to that temperature range, do not aid in the removal of arsenic and are consumed in vain. For example, the present inventor has examined weakly caking coals and strongly caking coals, which have customarily been employed in the reduction process for removing arsenic on an industrial scale, by thermally decomposing these coals under a reducing atmosphere in a differential thermal analyzer. Upon analysis, it was found that some of these coals lose approximately 90% by weight of their total starting weight in the course of elevation of the temperature thereof up to 900° C. Thus, these types of coals which lose most of their weight when heated to 900° C. or more, cannot be employed as effective reducing agents.

Pyrite cinders ordinarily contain arsenic in amounts of 0.1-0.5 wt.%, based on the total weight of the pyrite cinders. If the arsenic content is, for instance, 0.5% by weight, the theoretical amount of the reducing agent consisting of carbon, required for the reduction of arsenic, amounts to 0.04% by weight, based on the total weight of the pyrite cinders. In practice, however, a higher removal ratio of arsenic is achieved only when $Fe_2O_3$ contained in the pellets is simultaneously reduced to $Fe_3O_4$. If the reducing agent consumed for the reduction of $Fe_2O_3$ to $Fe_3O_4$ is taken into consideration, the total amount of the reducing agent required for the reductions is 0.71% by weight, based on the total weight of the pyrite chambers. But, in operations on an ordinary industrial scale, coals are incorporated in pyrite cinders in amounts of 3-4% by weight, based on the total weight of the pyrite cinders, and almost fully consumed. Most of the coals are apparently consumed without functional purpose or effect.

If the coal employed as the reducing agent is incorporated in any excess amount, a part of the iron oxide ($Fe_2O_3$) contained in the pyrite cinder is further reduced in the reduction process for removing arsenic to produce $Fe_3O_4$ or FeO. However, since the thus-produced iron compound is apt to form a low melting point composition together with Ca, Mg and Si, the surface of the pellet is likely to partially melt and produce a slag or gas-impermeable coating, thereby inhibiting removal of gaseous arsenious acid from the pellet. Moreover, since the step for the removal of nonferrous metals by the chlorinating volatilization method, which is carried out following the reductive step for removing arsenic, is operated at a temperature higher than that of the arsenic removal step by 200°-300° C., the melting of the pellets to form slag further inhibits the removal of nonferrous metals.

Moreover, there also exists the necessity of subjecting the pellets to an oxidizing treatment in advance because the chlorinating-volatilizing reaction proceeds under an oxidative atmosphere. And because FeO is reductive under such atmosphere, if the FeO content in the pellets is high, the installation of a large apparatus for the oxidizing treatment step is required, so that the process becomes disadvantageously costly.

Solid reducing agents, such as coal and coke, have an inherent drawback in that they are not able to permeate and disperse evenly among the particles and throughout the inside of the particles of pyrite cinders, because they are not able to be liquid. Accordingly, coal or coke must be added in a greatly excess amount of the theoretical amount calculated from the arsenic content, so that a large amount of iron oxide is also reduced along with the arsenic bringing troublesome effects as mentioned above. In addition, Ca and Mg usually contained in the coal react with As to produce calcium arsenate and magnesium arsenate, respectively, so that the arsenic removal ratio is reduced. Thus, the use of these solid reducing agents in such large amounts has detrimental effects and is undesirable.

Furthermore, there is another serious problem in the reductive arsenic removal step currently employed on an industrial scale. A certain number of pellets are pulverized or crushed down in the firing step in a rotary kiln because of insufficient pellet strength. This results in a decrease in the yield of the pellets and a loss in the efficiency of the separation and of the pellets from the gaseous arsenious acid and recovery of the pellets in the subsequent step for recovering the separated materials.

The amount of the pulverized pellets may sometimes reach 25% by weight of the total weight of the starting pellets, so that continuous operation is sometimes rendered impossible. A measure has been previously proposed for increasing the pellet strength; this measure comprises addition of an inorganic binder, such as bentonite, to the pellets. However, the effect of the addition of a binder decreases in the presence of coal or coke, which are imperative for the removal of arsenic. Morever, if the added inorganic material has a melting point lower than 900° C., it causes a slag to be produced, as described previously, which inhibits the arsenic removal reaction. Coke cannot work as a binder, and coal works as a binder only at an extremely low level. There is known a type of coal that displays exceptional fluidity, but even this type of coal does not work as a strong binder. Thus, the pellets are apt to be pulverized to a greater extent as the amount of the added coal is increased.

This invention provides a process involving the use of a pitch material reducing agent having a softening point in the range of 30°-300° C., as well as a high fluidity, a high binding effect and a low ash content. Such pitch materials include delayed thermal cracking pitch, thermal cracking coal tar pitch and coal extract. When used in place of the above-mentioned solid reducing agents having the drawbacks mentioned previously, these pitch materials enable the removal of arsenic contained in raw iron ores, such as pyrite cinder, efficiently under reducing conditions, and also increase pellet strength and thereby prevent pulverization of pellets which pulverization might cause interruption of the operation.

According to the process of the present invention, the pulverization of pellets that occurs in the conventional arsenic reductive removal step using coal or coke can be prevented. To achieve this effect, a pitch material such as coal extract, delayed thermal cracking pitch, or thermal cracking coal tar pitch, representatively is added to a raw iron ore, such as pyrite cinder, in the amount of 0.5–5% by weight, preferably of about 2–3% and more preferably about 2% by weight, based on the weight of the iron ore. The principal reasons why the amount of the reducing agent of this kind is so small are that most of the pitch materials have a softening point in the range of 70°–200° C. and a high fluidity at a temperature sufficiently higher than the softening point, properties which are different from those displayed by reducing agents such as coal and coke, and in addition have the following advantageous features.

First, a pellet produced by mixing, at first, pyrite cinders with the pitch material at a non-elevated temperature followed by granulating and heating contains pitch material evenly dispersed throughout the pyrite cinders, because the pitch material covers and permeates thoroughly over the solid particle surface and into the small pores of the particle in the heating step following the kneading and molding step. Second, the pitch material undergoes polycondensation in the pellet heating step and hardens itself to become a carbonized material. In the course of the polycondensation step, the molten pitch serves, while being carbonized, to combine the particles of the raw iron ore, such as pyrite cinder, whereby the surface walls of the solid particles are combined and the particles are integrated or united together.

Some coals melt at 400°–500° C. to a certain extent, but these permeate the inside of a pyrite cinder or the like only very slightly because the fluidity of such coals is much lower than that of the pitch materials. Further, at higher temperatures, such coals turn to char which results in expansion of their volumes. Therefore, even a type of coal which may give a relatively high pellet strength, such as approximately 2 Kg/l P (the highest crushing strength for one pellet under which pressure the pellet remains unbroken) at a low temperature of up to 400° C., only displays a reduced crushing strength of lower than 1 Kg/l P at a high temperature of 600° C. during the reductive arsenic removal process that involves heating up to approximately 1100° C. in a rotary kiln. Thus, the pellets becomes incapable of resisting the forces applied to them in the rotary kiln at high temperatures, so that the pellets are cracked, crushed or pulverized.

In contrast to coal, the pitch material permeates the insides of the pellets very thoroughly by permeating into and through the small cavities that result from evaporation of water contained in the pellets, or through the openings among the solid particles, and shows no substantial expansion. Therefore, a pellet impregnated with 2% by weight of coal extract, for instance, shows a crushing strength of at least 5.0 Kg/l P at a temperature of 400° C. and at least 3.0 Kg/l P at 800° C. The use of a petroleum pitch in place of the coal extract similarly imparts to the pellet a crushing strength at 800° C. higher than that achieved by other solid reducing agents such as coal and coke, and can completely prevent pellet pulverization in the rotary kiln.

A heavy oil, which is a reducing agent of an extremely high fluidity, contains low boiling fractions so that up to 90% or more of such a heavy oil evaporates from the pellet below or at 450° C. For this reason, a heavy oil cannot be employed as a preferable binder.

Colloidal silica, alumina sol, carboxymethylcellulose (CMC), lignin, polyvinyl alcohol and the like, which have been heretofore proposed as strength increasing agents for pellets of pyrite cinders and the like, can give only a low level of pellet strength under the firing conditions, and thus they are not satisfactory binders.

Pitch material utilized in the present invention is very effective as a binder at both low and high temperatures. In the preparation of the pellets, the pitch materials can be incorporated therein by mixing in the pitch material under stirring at a low temperature, or by spraying molten pitch material onto the pellets. Moreover, the pellets can then be dried by rapid heating with no harmful effects. Thus, there is no need to provide a large scale preliminary heating process as in the conventional process. Furthermore, since the pellets show an increased crushing strength in the heating step of the reductive arsenic removal process, the pellets can be piled up high in a rotary kiln. Thus, the amount of material that can be treated in one rotary kiln, per unit time, is increased, and accordingly this process is economically advantageous. Also, since the pitch material can be sprayed under heating over the pyrite cinders or can be easily mixed with the pyrite cinders at a non-elevated temperature with simple pulverization, there is no need to control the mixing extent of the powdery pyrite cinders and the reducing agent, such as is required in the conventional process, prior to supplying the mixture to the pelletizer, nor is there a need to strictly control the operation of the pellet-producing procedure with respect to such factors as the hardness, water content and size of the wet pellets. Therefore, the process using pitch material as a reducing agent is more economical and useful in these respects.

The arsenic content in iron ore, such as pyrite cinder, should be reduced to not greater than 0.01%, preferably 0.007%, more preferably 0.005% by weight after firing of the pellets.

According to the process of the present invention, the reduction of the arsenic content to about 0.005% by weight, for example, in pyrite chambers initially containing arsenic at 0.3–0.5% by weight, can be accomplished by adding to the pyrite chambers, pitch materials utilized in the present invention such as thermal cracking tar pitch, DTC pitch or SRC, or a mixture of two or more thereof in amounts of 2% by weight, based on the weight of the pyrite chambers, and then simply heating the mixture to 1000° C., for example, under a reducing atmosphere. Cokes or coals employed as reducing agents in conventional industrial processes cannot reduce the As content of the pellets to lower than about 0.007% by weight, even when added in amounts of 3% by weight.

The pitch material suitably employed in the reductive arsenic removal process of the present invention is one having a specific gravity of 1.02–1.90 at 15° C., a softening point in the range of 30°–300° C., an H/C atomic ratio of 0.2–1.5, and a $\beta$-resin content of 0.4–70% by weight. Preferred pitch materials have a specific gravity of 1.09–1.50, a softening point in the range of 60°–150° C., an H/C atomic ratio of 0.5–1.0, and a β-resin content of 20–40% by weight. β-Resin is the benzene soluble, quinoline insoluble component of pitch material.

Needless to say, the pitch material adopted in the present invention is also effective for the removal of arsenic from iron ores, other than pyrite cinders, that contain arsenic, and further can be utilized for the preparation of pellets for use in iron manufacture that are obtained from iron ores through reduction with a reducing agent. The pitch material can also be utilized in a mixture with a conventional reducing agent, such as coal or coke, in a ratio that does not injure the effect of the present invention substantially. Further the pitch material may be applied in a similar manner for the refining of nonferrous metals, with or without coke, coal or the like.

The present invention will be further explained by the following reference test examples, comparative examples and examples according to the present invention.

Table 1 shows the components and particle size distributions of the pyrite cinders employed as the raw material in the examples.

TABLE 1

Properties of Pyrite Cinder

| Item | Pyrite Cinder A | B | C | D | E |
|---|---|---|---|---|---|
| Components (wt %) | | | | | |
| Total Fe | 58.6 | 56.7 | 55.94 | 61.33 | 54.06 |
| FeO | 2.0 | 0.65 | 0.71 | 0.43 | 0.58 |
| Cu | 0.24 | 0.29 | 0.51 | 0.15 | 0.50 |
| Zn | 1.69 | 0.86 | 0.44 | 0.13 | 0.56 |
| Pb | 0.38 | 0.10 | 0.15 | 0.06 | 0.24 |
| Total S | 0.85 | 1.15 | 2.56 | 1.21 | 1.95 |
| Water Soluble S | 0.78 | 0.66 | 2.05 | 0.94 | 1.68 |
| As | 0.35 | 0.18 | 0.21 | 0.12 | 0.29 |
| $SiO_2$ | 8.92 | 7.74 | 2.40 | 3.77 | 7.60 |
| CaO | 1.0 | 1.30 | 7.27 | 1.21 | 3.50 |
| $Al_2O_3$ | 1.15 | 1.59 | 1.21 | 0.65 | 1.47 |
| MgO | 0.23 | 0.73 | 0.54 | 0.43 | 0.67 |
| Particle Size Distribution (wt %) | | | | | |
| 44 μ or less*1 | 85.0 | 82.4 | 84.2 | 85.8 | 84.7 |
| 10 μ or less*2 | 45.6 | 42.3 | 43.1 | 46.9 | 45.2 |

*1Measured by the wet method using a sieve.
*2Measured by the wet sedimentation method.

Tables 2 and 3 show the types and properties of the reducing agents employed.

TABLE 2

Properties of Reducing Agent (1) (Comparative Reducing Agent)

| Item | Kind: Non-Japanese Coal A | Non-Japanese Coal B | Japanese Coal | Coke |
|---|---|---|---|---|
| Total Water Content (wt %) | 1.3 | 1.4 | 1.0 | — |
| Industrial Analysis (wt %) | | | | |
| Ash | 9.0 | 10.9 | 7.6 | 13.0 |
| Volatile | 39.8 | 41.1 | 39.4 | 2.5 |
| Fixed Carbon | 49.9 | 46.6 | 52.1 | 84.5 |
| Elementary Analysis (wt %) | | | | |
| C | 75.0 | 73.9 | 78.7 | 84.0 |
| H | 5.6 | 5.3 | 5.7 | 1.2 |
| O | 7.6 | 6.1 | 4.9 | 0.5 |
| N | 1.5 | 1.0 | 1.7 | 0.6 |
| S | 1.2 | 2.6 | 0.4 | 0.7 |

TABLE 2-continued

Properties of Reducing Agent (1) (Comparative Reducing Agent)

| Item | Kind: Non-Japanese Coal A | Non-Japanese Coal B | Japanese Coal | Coke |
|---|---|---|---|---|
| Composition of Ash (wt %) | | | | |
| $SiO_2$ | 42.0 | 43.7 | 44.3 | 40.5 |
| $Al_2O_3$ | 23.0 | 24.0 | 26.9 | 27.5 |
| $Fe_2O_3$ | 7.2 | 5.6 | 17.5 | 11.5 |
| CaO | 7.1 | 8.4 | 5.8 | 5.0 |
| MgO | 2.3 | 2.2 | 2.0 | 2.7 |
| $Na_2O$ | 3.0 | 2.1 | 2.5 | 2.0 |
| $K_2O$ | 0.9 | 0.8 | 1.2 | 2.0 |
| $SO_3$ | — | — | 0.9 | 0.7 |
| $P_2O_5$ | — | — | 0.8 | 0.7 |

TABLE 3

Properties of Reducing Agent (2)

| | Heavy Oil C (Comparison) | TCCT* Pitch (Invention) | DTC*1 Pitch A (Invention) | DTC Pitch B (Invention) | SRC*2 (Invention) |
|---|---|---|---|---|---|
| Softening Point (°C.) | — | 70 | 60 | 110 | 140 |
| Industrial Analysis (wt %) | | | | | |
| Ash | 0.02 | 0.1 | 0.2 | 0.3 | 0.2 |
| Volatile | 90.9 | 50.1 | 61.5 | 51.6 | 53.7 |
| Elementary Analysis (wt %) | | | | | |
| C | 85.8 | 92.8 | 86.1 | 87.2 | 88.7 |
| H | 12.2 | 3.9 | 8.1 | 7.0 | 4.9 |
| N | 0.3 | 1.1 | 1.2 | 1.3 | 1.4 |
| S | 2.5 | 0.4 | 2.9 | 3.2 | 0.3 |
| Insolubles (wt %) | | | | | |
| n-Heptane | — | 78.7 | 48.3 | 80.1 | 75.7 |
| Benzene | — | 38.7 | 27.9 | 52.9 | 33.0 |
| Quinoline | — | 11.6 | 7.9 | 18.5 | 0.4 |
| β-Resin*3 | — | 26.7 | 20.0 | 34.4 | 32.6 |
| Aromaticity (H/C) | 1.71 | 0.50 | 1.13 | 0.96 | 0.61 |
| Specific Gravity | 0.88 | 1.283 | 1.098 | 1.229 | 1.249 |

Notes:
*TCCT = Thermal Cracking Coal Tar
*1DTC = Delayed Thermal Cracking
*2SRC = Solvent Refined Coal
*3β-Resin is the benzene soluble, quinoline insoluble component of pitch material.

It has been described previously that a high temperature is required to remove arsenic from pyrite cinders. It has been further described that since the temperature at the exit end of the kiln is generally maintained at 1000°–1050° C., in the process for the removal of arsenic from the pyrite cinders pelletized with a reducing agent in a rotary kiln, it is very important that the reducing agent shall remain in the cinders at such a high temperature. Table 4 shows the results of differential thermal analysis in which 10–20 mg of a reducing agent selected from the pitch materials SRC, DTC pitch and thermal cracking coal pitch, which are employed in the process of the present invention, and comparison reducing agents selected from heavy oil, coke and coal were heated to 900° C. at a temperature elevation rate of 10° C./min, in a stream of nitrogen, at a flow rate of 90 ml/min, in a thermobalance.

TABLE 4

Thermal Analytical Data of Reducing Agents under a Nitrogen Atmosphere*1

| No. | Reducing Agent | Temperature at which Weight Loss Begins | Weight Remaining Ratio (Percentage of Starting Weight that Remains at the Indicated Temperature) 300° C. | 500° C. | 700° C. | 900° C. |
|---|---|---|---|---|---|---|
| 1 | Non-Japanese Coal A*2 | 100 | 89.8 | 62.2 | 39.8 | 19.9 |
| 2 | Non-Japanese Coal B*2 | 340 | 100 | 77.1 | 45.8 | 25.0 |
| 3 | Japanese Coal*2 | 100 | 94.9 | 66.3 | 49.0 | 33.7 |
| 4 | Coke | 140 | 98.4 | 97.6 | 90.5 | 73.8 |
| 5 | Heavy Oil C | 120 | 68.94 | 11.80 | 8.07 | — |
| 6 | Thermal Cracking Coal Tar Pitch | 145 | 79.1 | 47.3 | 47.3 | 45.1 |
| 7 | DTC Pitch A | 240 | 98.5 | 44.2 | 37.2 | 17.8 |
| 8 | DTC Pitch B | 280 | 99.0 | 54.1 | 49.7 | 40.3 |
| 9 | SRC | 240 | 98.3 | 62.3 | 62.3 | 52.5 |

*1$N_2$ flow rate 90 ml/min, heat elevation rate 10° C./min.
*2Dried at 70° C., under 5 mmHg, for 3 hours.

As is clear from Table 4, the behavior of coal with respect to the change of the weight remaining ratio versus heating temperature varied depending on the kind of coal tested. Non-Japanese Coal A, for instance, showed a weight remaining ratio of 19.9% at 900° C., and upon subtraction of the ash content, the weight remaining ratio amounts to approximately 11%, which means that the greater part of the coal was thermally cracked or evaporated. By contrast, the pitch materials such as SRC, DTC pitch B and thermal cracking coal pitch showed high weight remaining ratios, and therefore these materials are advantageous for use in the arsenic removal process.

Reference Test Examples

In separate tests, crushed coal was mixed with pyrite cinders in amounts in the range of 1.0–4.0% by weight, and to the mixture water was added in the amount of 12–16% by weight. The mixture was kneaded and treated to form pellets of a diameter of 10 mm and a weight of approximately 1.2 g each. The pellets were then dried preliminarily at 150° C. for 30 minutes in an electric dryer (volume: 400×400×400 mm) and then were subjected to an arsenic removal test using an externally heated horizontal electric furnace (diameter: 50 mm, length: 1200 mm). The test was carried out by heating the pellets in the furnace to 900°–1000° C. under a nitrogen atmosphere and then maintaining them at that temperature for 15 minutes to fire the pellets. At each predetermined temperatures, the pellets were fired and measured to determine the FeO content, the remaining As content and the strength thereof. The results are set forth in Table 5. For the measurement of the crushing strength of the pellets, Kiya hardness testers (two types, their measurable range being 0–5 Kg and 0–50 Kg, respectively) were employed. The measurement data are set forth in terms of the mean values of the measurements for 5 to 10 pellets.

TABLE 5

Reductive Arsenic Removal Reaction of Pyrite Cinders with Coal

| No. | Amount of Added Coal (wt %) | Analysis Item | Firing Temperature (°C.) 900 | 950 | 1000 |
|---|---|---|---|---|---|
| 1 | 1.0 | CS (Kg/l P)*1 | | | 4.7 |
| | | FeO (wt %)*2 | | | 12.2 |
| | | As Content of Pellets (wt %) | | | 0.14 |
| | | Arsenic Removal Ratio (%) | | | 22.3 |
| 2 | 2.0 | CS (Kg/l P)*1 | 1.5 | 2.3 | 9.2 |
| | | FeO (wt %)*2 | 19.6 | 20.6 | 23.7 |
| | | As Content of Pellets (wt %) | 0.18 | 0.13 | 0.07 |
| | | Arsenic Removal Ratio (%) | 1.1 | 27.8 | 61.7 |
| 3 | 3.0 | CS (Kg/l P)*1 | 7.4 | 12.8 | 34.5 |
| | | FeO (wt %)*2 | 24.1 | 24.9 | 32.2 |
| | | As Content of Pellets (wt %) | 0.08 | 0.02 | 0.01 |
| | | Arsenic Removal Ratio (%) | 55.0 | 90.6 | 94.5 |
| 4 | 4.0 | CS (Kg/l P)*1 | 8.0 | 13.5 | 27.4 |
| | | FeO (wt %)*2 | 25.7 | 33.4 | 38.1 |
| | | As Content of Pellets (wt %) | 0.09 | 0.01 | 0.01 |
| | | Arsenic Removal Ratio (%) | 47.8 | 94.5 | 93.9 |

*1Crushing strength; Strength per one pellet
*2FeO content of pellets

As shown in Table 5, the results teach that, when coal is used as the reducing agent, an arsenic removal ratio of higher than 90% can be accomplished only when the coal is added in amounts of 3.0% by weight or more and the firing temperature is 950° C. or higher. The results further indicate that there is a certain relationship between the crushing strength, FeO content and the remaining As content of the fired pellets. Furthermore, the present experiments of the reductive arsenic removal reaction show that the arsenic highly dispersed within the pellets escapes more readily because the $Fe_2O_3$ present around the arsenic is reduced with a reducing agent to give FeO. The conversion of $Fe_2O_3$ to FeO further serves to impart increased strength to the pellets.

EXAMPLE 1

A pitch material, either SRC, DTC pitch or thermal cracking tar pitch, was added to pyrite cinders in amounts in the range of 1.0–3.0% by weight and then the mixture was pelletized in the same manner as described in Reference Test Examples. The pellets were dried at 150° C. for 5 minutes in the electric dryer employed in the Reference Test Examples and were heated to fire same at 150°, 400°, 600° or 800° C. for 20 minutes under a gaseous nitrogen atmosphere in the horizontal electric furnace. The pellets were then cooled under nitrogen to room temperature, and then the crushing strength (CS) and the dropping strength (DS) of the pellets were measured. At the same time, cracking and crushing (breaking-down) of the pellets caused by the firing were examined. Table 6 shows the results of runs employing a reducing agent such as coal, coke or heavy oil or employing a combination of the coal with a variety of binders, as well as the results of runs employing pyrite cinder only and results employing pitch materials according to the present invention.

The dropping strength (DS) is indicated by the number of times needed to produce cracks in or breaking-down of the pellets as a result of repeated procedures involving dropping of the pellets onto a floor made of concrete from a height of 50 cm.

TABLE 6

| Run No. | Pyrite Cinder | Additives (Amount wt %) | Measurement Item | Results of Heat Treatment*1 Pellets under Nitrogen Atmosphere: Treating Temperature (°C.) 150 | 400 | 600 | 800 |
|---|---|---|---|---|---|---|---|
| (Comparison) | | | | | | | |
| 1 | A | — | CS*2 | 0.73 | 0.78 | 1.00 | 1.88 |
| | | | DS*3 | 1 | 1 | 1 | 1 |
| | | | CB*4 | none | none | none | none |
| 2 | C | — | CS | 1.75 | 0.55 | 0.77 | 1.00 |
| | | | DS | 1 | 1 | 1 | 1 |
| | | | CB | none | none | none | none |
| 3 | A | Non-Japanese Coal A (2.0) | CS | 1.50 | 0.58 | 0.38 | 0.38 |
| | | | DS | 1 | 1 | 1 | 1 |
| | | | CB | none | none | none | none |
| 4 | C | Non-Japanese Coal A (3.0) | CS | 1.00 | 0.33 | 0.20 | 0.15 |
| | | | DS | 1 | 1 | 1 | 1 |
| | | | CB | none | none | none | observed |
| 5 | D | Japanese Coal (3.0) | CS | 1.20 | 1.43 | 1.48 | 1.00 |
| | | | DS | 1 | 1 | 1 | 1 |
| | | | CB | none | none | none | none |
| 6 | A | Coke (3.0) | CS | 0.58 | 0.83 | 0.85 | 2.15 |
| | | | DS | 1 | 1 | 1 | 1 |
| | | | CB | none | none | none | none |
| 7 | C | Heavy Oil C (3.0) | CS | 1.48 | 5.7 | 1.02 | 0.95 |
| | | | DS | 1 | 4 | 1 | 1 |
| | | | CB | none | none | none | none |
| 8 | C | Non-Japanese Coal A (2.0) Heavy Oil C (1.0) | CS | 1.45 | 1.68 | 0.62 | 0.48 |
| | | | DS | 1 | 1 | 1 | 1 |
| | | | CB | none | none | none | none |
| 9 | A | Non-Japanese Coal B (3.0) Bentonite (3.0) | CS | 1.83 | 0.92 | 0.70 | 0.89 |
| | | | DS | 1 | 1 | 1 | 1 |
| | | | CB | none | none | none | none |
| 10 | C | Non-Japanese Coal A (3.0) Lignin (1.2) | CS | 1.30 | 2.5 | 0.95 | 0.81 |
| | | | DS | 1 | 2 | 1 | 1 |
| | | | CB | none | observed | observed | observed |
| 11 | C | Non-Japanese Coal A (3.0) CMC (1.2) | CS | 5.0 | 0.28 | 0.35 | 0.30 |
| | | | DS | 8 | 1 | 1 | 1 |
| | | | CB | none | none | none | none |
| 12 | C | Non-Japanese Coal A (3.0) Portland Cement (1.0) | CS | 0.6 | 0.38 | 0.35 | 0.30 |
| | | | DS | 1 | 1 | 1 | 1 |
| | | | CB | none | none | none | none |
| 13 | C | Non-Japanese Coal A (3.0) (Colloidal) Silica | CS | 1.48 | 1.85 | 0.25 | 0.10 |
| | | | DS | 1 | 2 | 1 | 1 |
| | | | CB | none | observed (5.0) | observed | observed |
| 14 | C | Non-Japanese Coal A (3.0) Alumina Sol (10.0) | CS | 1.98 | 1.35 | 0.45 | 0.15 |
| | | | DS | 1 | 1 | 1 | 1 |
| | | | CB | none | none | none | none |
| (Invention) | | | | | | | |

TABLE 6-continued

| Run No. | Pyrite Cinder | Additives (Amount wt %) | Measurement Item | Results of Heat Treatment*1 Pellets under Nitrogen Atmosphere: Treating Temperature (°C.) 150 | 400 | 600 | 800 |
|---|---|---|---|---|---|---|---|
| 15 | E | Thermal Cracking Coal Tar Pitch (2.0) | CS | 2.88 | 4.20 | 1.20 | 1.63 |
| | | | DS | 3 | 2 | 1 | 1 |
| | | | CB | none | none | none | none |
| 16 | E | DTC Pitch A (1.0) | CS | 2.00 | 2.43 | 1.10 | 1.63 |
| | | | DS | 1 | 1 | 1 | 1 |
| | | | CB | none | none | none | none |
| 17 | E | DTC PItch A (2.0) | CS | 2.50 | 6.50 | 4.65 | 2.10 |
| | | | DS | 3 | 7 | 5 | 1 |
| | | | CB | none | none | none | none |
| 18 | A | DTC Pitch A (2.0) | CS | 1.5 | 4.92 | 1.38 | 1.18 |
| | | | DS | 1 | 4 | 1 | 1 |
| | | | CB | none | none | none | none |
| 19 | A | DTC Pitch B (1.0) | CS | 1.50 | 1.63 | 0.82 | 0.88 |
| | | | DS | 1 | 1 | 1 | 1 |
| | | | CB | none | none | none | none |
| 20 | A | DTC Pitch B (2.0) | CS | 1.35 | 5.05 | 2.05 | 2.67 |
| | | | DS | 1 | 3 | 2 | 2 |
| | | | CB | none | none | none | none |
| 21 | A | DTC Pitch B (3.0) | CS | 1.60 | 6.8 | 4.2 | 3.05 |
| | | | DS | 1 | 9 | 4 | 3 |
| | | | CB | none | none | none | none |
| 22 | C | SRC (2.0) | CS | 1.30 | 5.25 | 4.65 | 3.33 |
| | | | DS | 1 | 7 | 3 | 3 |
| | | | CB | none | none | none | none |
| 23 | C | SRC (3.0) | CS | 1.4 | 6.5 | 5.0 | 4.5 |
| | | | DS | 1 | 5 | 5 | 4 |
| | | | CB | none | none | none | none |
| 24 | A | SRC (2.0) | CS | 1.5 | 5.0 | 4.0 | 3.5 |
| | | | DS | 1 | 5 | 3 | 3 |
| | | | CB | none | none | none | none |
| 25 | A | SRC (3.0) | CS | 1.7 | 7.0 | 4.5 | 5.5 |
| | | | DS | 1 | 10 | 4 | 5 |
| | | | CB | none | none | none | none |

*1Treating Time: 20 minutes
*2CS = Crushing Strength (Kg/l P)
*3DS = Dropping Strength (number of times)
*4CB = Cracks or Breaking-down Table 6 shows that the addition of the non-Japanese coals in amounts of 2–3% by weight did not increase the pellet strength during the heating treatment at 400° C. through 800° C., as compared with the pellets to which no additive was added, and that the CS values were lower than 1 Kg/l P. Run No. 5 shows that Japanese coal gave slightly higher CS values in treatments at 150°–600° C., but gave a lower value in the treatment at 800° C. Run No. 6 shows that the coke gave low CS values in the treatments even at 150°–600° C., and Run No. 7 shows that the heavy oil gave a low CS value of less than 1 Kg/l P in the treatment at 800° C. so as to sometimes produce cracks and breaking down of the pellets during practical firing at higher temperatures where the pellet layer in the kiln is far thicker than in the experiments in these examples.

Even the combinations of the coals with binders, such as bentonite, lignin, CMC (carboxymethyl cellulose), Portland cement, colloidal silica and alumina sol, gave low CS values in the treatments at 600° C. through 800° C., and cracks or breaking-down of the pellets were observed in some cases. In contrast to these results, Run Nos. 15–25, involving the additions of thermal cracking coal pitch, DTC pitch A, DTC pitch B or SRC in amounts of at least 0.5% by weight, showed that the pellets treated with these additives had high CS values in the treatments at 400° C. through 800° C. The adhesion property of these additives was thus ascertained. In particular, the use of DTC pitch B and SRC, as a whole gave CS and DS values higher than the values given by coal or coke, and, in certain examples, other additives.

It is evident that the addition of the above-described pitch materials in amounts of at least 0.5% by weight in the reductive arsenic removal process for pelletized pyrite cinders employing a rotary kiln gives CS values of not less than 1 Kg/l P, which is necessary to prevent the pellets from being crushed and pulverized in the rotary kiln. It is also evident that these pitch materials are highly effective reducing agents, as compared with coal and coke.

EXAMPLE 2

In separate tests, reducing agent pitch materials, including thermal cracking coal pitch, DTC pitch and SRC, and coal, coke and heavy oil were added to pyrite cinders selected from five kinds of pyrite cinders containing 0.12–0.35% by weight of arsenic, and the mixtures were pelletized as described in the Reference Test Examples. The pellets were dried at 150° C. for 30 minutes in the electric dryer and then were charged into the horizontal electric furnace maintained at 400° C., in a stream of nitrogen, at the flow rate of 100 ml/min. The temperature of the furnace was elevated to 1000° C. over 60 minutes, and maintained at that temperature for 10 minutes to carry out the firing. The furnace was then cooled to room temperature under the nitrogen atmosphere. The measurements for determinations of the crushing strength, FeO content and remaining As content were made in order to compare the reducing agents.

The results are set forth in Table 7.

TABLE 7

| Run No. | Pyrite Cinder | Results of Reductive Arsenic Removal Reactions of Pyrite Cinders: Reducing Agent (Amount wt %) | Crushing Strength (Kg/l P) | FeO (wt %) | Remaining As Content (wt %) | As Removal Ratio (%) |
|---|---|---|---|---|---|---|
| Comparisons | | | | | | |
| 1 | A | — | 13.4 | less than 0.2 | 0.347 | 0.0 |
| 2 | A | Non-Japanese Coal A (2.0) | 9.4 | 21.3 | 0.024 | 93.1 |
| 3 | A | Non-Japanese Coal (A) (3.0) | 17.9 | 29.9 | 0.006 | 98.3 |
| 4 | A | Non-Japanese Coal B (1.0) | 4.7 | 12.2 | 0.234 | 32.6 |
| 5 | A | Non-Japanese Coal B (3.0) | 16.9 | 30.2 | 0.007 | 98.0 |
| 6 | D | Japanese Coal (3.0) | 18.5 | 31.8 | 0.006 | 98.3 |
| 7 | A | Coke (2.0) | 13.4 | 22.6 | 0.064 | 81.6 |
| 8 | A | Coke (3.0) | 10.0 | 22.9 | 0.027 | 92.2 |
| 9 | A | Heavy Oil C (1.0) | 2.1 | 13.8 | 0.270 | 22.2 |
| 10 | A | Heavy Oil C (2.0) | 4.9 | 18.0 | 0.110 | 68.3 |
| 11 | A | Heavy Oil C (3.0) | 13.8 | 24.0 | 0.011 | 96.8 |
| Invention | | | | | | |
| 12 | A | Thermal Cracking Coal Pitch (0.5) | 3.8 | 7.3 | 0.252 | 27.4 |
| 13 | A | Thermal Cracking Coal Pitch (2.0) | 20.0 | 25.4 | 0.005 | 98.6 |
| 14 | A | DTC Pitch A (1.0) | 3.4 | 10.3 | 0.191 | 45.0 |
| 15 | A | DTC Pitch A (2.0) | 12.6 | 23.9 | 0.011 | 96.8 |
| 16 | A | DTC Pitch B (1.0) | 4.7 | 14.1 | 0.0182 | 52.0 |
| 17 | A | DTC Pitch B (2.0) | 15.3 | 25.7 | 0.005 | 98.6 |
| 18 | A | DTC Pitch B (3.0) | 28.9 | 40.0 | 0.003 | 99.1 |
| 19 | A | SRC (0.5) | 3.9 | 6.2 | 0.256 | 26.3 |
| 20 | A | SRC (1.0) | 5.0 | 12.0 | 0.221 | 36.3 |
| 21 | A | SRC (2.0) | 17.6 | 27.0 | 0.003 | 99.1 |
| 22 | A | SRC (3.0) | 18.3 | 37.2 | 0.003 | 99.1 |

The results of Run Nos. 3, 5 and 6 in Table 7, each of which employed coal, show that coal addition amounts of 3% by weight were required to reduce the remaining arsenic content to 0.006–0.007% by weight. Even in the case of Runs Nos. 8 and 11, in which a coke and a heavy oil were respectively added in amounts of 3% by weight, the remaining arsenic amounts were 0.027 and 0.011% by weight, respectively. Thus, these materials were even poorer in their arsenic removal ratio than the coals tested.

In contrast to these materials, the effect of addition of the pitch materials was remarkable. For instance, Run No. 13, which employed 2% by weight of the thermal cracking coal pitch, Run No. 17, which employed DTC pitch, and Run No. 21, which employed SRC, all showed higher crushing strengths of the pellets, higher FeO contents, and significantly higher arsenic removal ratios in the range of 98.6–99.1%, as calculated from the remaining arsenic content of 0.003–0.005% by weight, compared with the runs employing coal, coke or heavy oil. In particular, the mere addition of 2% by weight of SRC gave approximately 0.003% by weight of remaining arsenic content and a 99.1% arsenic removal ratio. These results clearly indicate such materials are excellent reducing agents for pyrite cinders.

The embodiments of the present invention in which an exclusive property or privilege is claimed are defined as follows:

1. A process for preparing pellets from iron pyrite cinder containing arsenic as an impurity in an amount of at least 0.1 wt. %, and removing arsenic from the pellets during the preparation of the pellets, which comprises the steps of:

(a) mixing iron pyrite cinder containing arsenic as an impurity, with solvent refined coal having a softening point in the range of 30° C. to 300° C., wherein the amount of said solvent refined coal is in the range of from 0.5% to 5.0% by weight, based on the weight of said iron pyrite cinder;

(b) molding the mixture into pellets; and (c) removing arsenic from said pellets by heating said pellets under a reducing atmosphere, at a temperature effective to convert the arsenic impurity to gaseous arsenious acid, thereby reducing the arsenic content of said pellets to an amount not greater than about 0.01 wt. %.

2. A process according to claim 1 wherein step (c) is carried out such that the temperature of said pellets reaches at least 800° C.

3. A process according to claim 1 wherein said solvent refined coal has a specific gravity in the range of 1.02 to 1.90 at 15° C., an H/C atomic ratio of 0.2 to 1.5, and a $\beta$-resin content of 0.4 to 70% by weight.

4. A process according to claim 1 wherein said solvent refined coal has a specific gravity of 1.09 to 1.50, a softening point of 60° C. to 150° C., an H/C atomic ratio of 0.5 to 1.0, and a $\beta$-resin content of 20% to 40% by weight.

5. A process according to claim 1 or claim 3 wherein in step (a) said solvent refined coal is sprayed in molten form over said iron pyrite cinder.

6. A process according to claim 1 or claim 3 wherein in step (a) said solvent refined coal is mixed with said iron pyrite cinder, said iron pyrite cinder being in powdery form, at a non-elevated temperature.

7. A process according to claim 1 or claim 3 wherein said iron pyrite cinder contains 0.1 to 0.5 wt. % arsenic.

8. A process according to claim 1 or claim 3 in which in step (c), the pellets are heated to from about 900° to about 1000° C.

9. A process according to claim 1 or claim 3 in which in step (a), the amount of said solvent refined coal is in the range of from about 2 wt. % to about 3 wt. %, based on the weight of said iron pyrite cinder.

10. A process for preparing pellets from iron pyrite cinder containing arsenic as an impurity, in an amount of at least 0.1 wt. % and removing arsenic from the pellets during the preparation of the pellets, which comprises the steps of:

(a) mixing iron pyrite cinder containing arsenic as an impurity with solvent refined coal having a softening point in the range of 30° C. to 300° C., wherein the amount of said solvent refined coal is in the range of from 0.5% to 5.0% by weight, based on the weight of said iron pyrite cinder;

(b) molding the mixture into pellets;

(c) removing arsenic from said pellets by heating said pellets under a reducing atmosphere at a temperature effective to convert the arsenic impurity to gaseous arsenious acid, thereby reducing the arsenic content of said pellets to an amount not greater than about 0.01 wt. %; and (d) then removing metals including Cu, Zn and Pb from said pellets by treating said pellets with a chlorinating agent.

11. A process as claimed in claim 10, wherein said chlorinating agent is $CaCl_2$.

12. A process for preparing pellets from iron pyrite cinder particles containing arsenic compounds as an impurity, said particles containing at least about 0.1 wt. % arsenic, and removing arsenic from the pellets during the preparation of the pellets, which comprises the steps of:

mixing said iron pyrite cinder particles with from 0.5 to 5.0 wt. %, based on the weight of said iron pyrite cinder particles, of a hydrocarbon solvent refined coal having a specific gravity of from 1.02 to 1.90 at 15° C., a softening point in the range of from 30° to 300° C., an H/C atomic ratio of from 0.2 to 1.5 and a $\beta$-resin content of from 0.4 to 70 wt. %, wherein said $\beta$-resin is benzene-soluble quinoline-insoluble material, whereby to obtain a mixture;

then forming the mixture into pellets and heating the pellets to cause said solvent refined coal to cover and permeate said ore particles and to cause polycondensation and carbonization of said solvent refined coal to obtain pellets having a high crushing strength at a temperature of 800° C.; and then heating said pellets, under a reducing atmosphere, to a temperature in the range of from about 800° to about 1000° C. and for a time period effective to convert the arsenic compounds into gaseous arsenious acid until the arsenic contents of the pellets is less than 0.01 wt. %.

* * * * *